United States Patent [19]

Schroeder et al.

[11] 4,272,202

[45] Jun. 9, 1981

[54] RIBBON CARTRIDGE WITH BROKEN UNIDIRECTIONAL FRICTION DRIVE AND SELF CLEANING GEARS

[75] Inventors: Marvin C. Schroeder, Missionviejo; Edwin O. Stastny, Santa Ana, both of Calif.

[73] Assignee: Data Card Corporation, Minneapolis, Minn.

[21] Appl. No.: 944,162

[22] Filed: Sep. 20, 1978

[51] Int. Cl.[3] ..... B41J 33/14

[52] U.S. Cl. ..... 400/208; 400/234; 400/235.1; 400/641

[58] Field of Search ..... 400/194, 195, 196, 196.1, 400/207, 208, 208.1, 234, 235, 235.1, 636, 641

[56] References Cited

U.S. PATENT DOCUMENTS

| | | | |
|---|---|---|---|
| 944,746 | 12/1909 | Rice | 400/641 |
| 1,098,840 | 6/1914 | Rennie | 400/641 |
| 3,042,179 | 7/1962 | Stern | 400/641 X |
| 3,075,627 | 1/1963 | Kuckhoff | 400/208 |
| 3,804,227 | 4/1974 | Cappotto et al. | 400/234 |
| 3,918,569 | 11/1975 | Parker | 400/196 |
| 3,960,259 | 6/1976 | Guerrini et al. | 400/208 |
| 3,967,790 | 7/1976 | Hess | 400/196 X |
| 3,974,906 | 8/1976 | Lee et al. | 400/196.1 |
| 4,010,839 | 3/1977 | Guerrini et al. | 400/207 |
| 4,011,933 | 3/1977 | Kern | 400/208 |
| 4,026,492 | 5/1977 | Kern | 400/208 X |
| 4,053,042 | 10/1977 | Hess | 400/196 |
| 4,058,197 | 11/1977 | West | 400/208 |
| 4,074,799 | 2/1978 | Hishida et al. | 400/234 |
| 4,147,439 | 4/1979 | Colecchi | 400/234 X |
| 4,154,341 | 5/1979 | Osanai | 400/207 X |

FOREIGN PATENT DOCUMENTS 677518 6/1939 Fed. Rep. of Germany ..... 400/641

OTHER PUBLICATIONS

IBM Technical Disclosure Bulletin, "Nonstick Capstan Pinch Rolls," Denson et al. vol. 20, No. 2, Jul. 1977, pp. 710–711.

*Primary Examiner*—Ernest T. Wright, Jr.
*Attorney, Agent, or Firm*—Staas and Halsey

[57] ABSTRACT

A printer ribbon cartridge device includes structure for maintaining tension of a printer ribbon which is supplied and contained on a supply spool having an automatic brake for preventing unwinding thereof whenever the cartridge is not installed on a printer. Ribbon guide structure is provided so that the printer ribbon will be confined to a desired path, positive capstan feed rollers are provided of intermeshing gear type for positive feed of the printer ribbon and further gearing is provided to positively drive a slipping clutch element for a take-up spool. A one-way locking pawl also engages with the gearing to prevent rewinding of the printer ribbon after use and thereby prevent the reuse of same. The slip clutch for the take-up spool employs a gear driven input hub member provided with a central recess thereacross for supporting a deformed ring in an oval shape for driving contact by portions of the other circumference thereof against the inner surface of an outer take-up spool hub member. The overall device includes a first support panel and a second support panel having complementary projections and boss apertures formed respectively therewith for easy rapid assembly of all the components into a completed cartridge device.

18 Claims, 11 Drawing Figures

FIG. 8.
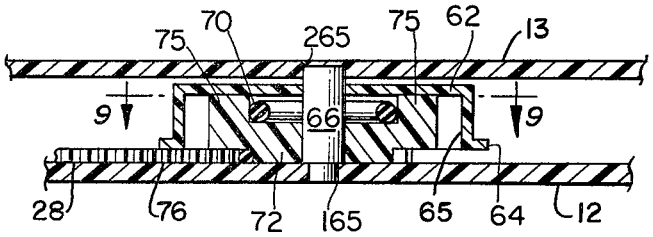
FIG. 9.
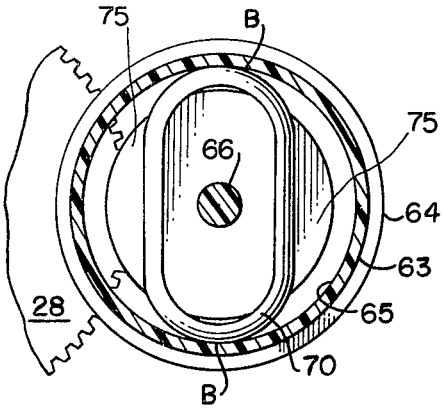
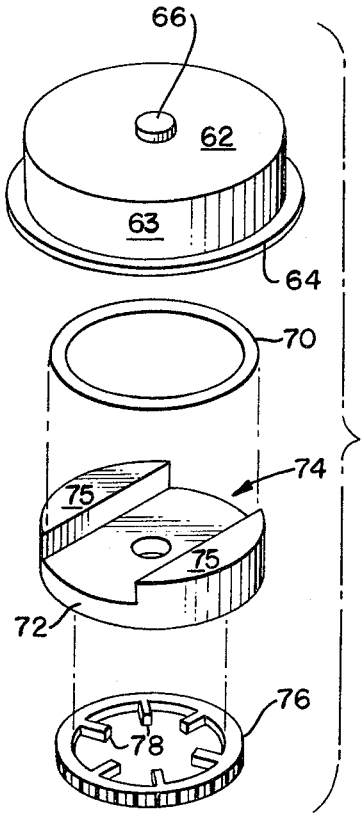
FIG. 10.
FIG. 11.
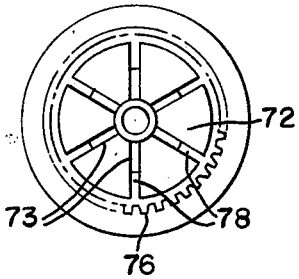

RIBBON CARTRIDGE WITH BROKEN UNIDIRECTIONAL FRICTION DRIVE AND SELF CLEANING GEARS

BACKGROUND OF THE INVENTION

1. Field of the Invention

The present invention is directed to a printer ribbon cartridge device for containing and protecting printer ribbons as provided for and intended for use with various high speed printers.

2. Description of the Prior Art

A number of known type printer ribbon cartridge devices are available, but they have a number of deficiencies which not only cause printer/cartridge malfunctions but also make the cartridge difficult and awkward to load into the printer platform.

Specific deficiencies of known cartridge devices are the lack of a tension device to keep the ribbon taut during transit of the cartridge, or whenever the cartridge is not installed in the printer. Furthermore, ribbon that is not under tension, but instead is loose and unguided makes insertion of the cartridge into the printer carriage very difficult because of the small clearance between the card guide and the platen of the printer.

Another deficiency of known devices is the lack of any anti-backwind device to eliminate the possibility of accidental rewinding of the cartridge during handling thereof with the consequential result that if the cartridge is used after such rewinding the desired printing will occur with a used portion of the ribbon. Also, if the ribbon is reused the chances of snarling of the ribbon with subsequent cartridge jamming is greatly increased.

A further problem with known type cartridge devices is that a rubber belt is commonly used to provide both the drive and the slip for the ribbon take-up spool. This is an anomaly, for if more tension is required to effect a tight rewind then this same additional tension opposes the required slipping action and the belt then does not function properly as a slip clutch. A slipping clutch function is required to maintain a constant tension as the take-up spool diameter increases in size during the printing operation as the printing ribbon is being fed through the cartridge and wound up. Another design weakness in the use of a rubber belt drive is that the inherent characteristic of the rubber is to elongate under load. Also, the shelf life of the cartridge is severely limited by this physical property. That is, cartridges that function properly shortly after the initial manufacture thereof may not function properly after six months or so due to the change of the rubber characteristics and/or belt stretch.

SUMMARY OF THE INVENTION

The printer ribbon cartridge device of the present invention overcomes the deficiencies as described above of previous type devices.

A brake pad structure is provided for the full ribbon supply and prevents unwinding thereof whenever the cartridge is not in the printer. This brake structure is spring tensioned into engagement with the ribbon, and includes projecting pins which come in contact with the frame structure of a printer upon mounting the overall cartridge in a printer to automatically disengage the brake pad from the ribbon supply spool.

A further feature of the present invention is the provision of anti-backwind pawl structure to prevent inadvertent winding of the printer ribbon in the wrong direction. This pawl is in engagement with a gear which in turn engages with a gear type feed capstan structure. The feed capstan structure positively feeds the printer ribbon during operation of the printer with which the cartridge is associated, but can only be turned in the proper feed direction because of the anti-backwind pawl. This simple feature provides a very important proper operating function for the overall cartridge device.

Also in driving engagement with the above-described gearing is a slip clutch mechanism for the take-up spool for the used ribbon. This slip clutch mechanism includes an inner drive hub slightly smaller in overall diameter than the smooth finished inner circumference of the take-up spool. A main central recess is provided on the inner hub which removably constrains therewithin an O-ring which is deformed into an oval shape. Each of the respective ends across the longest portion of the deformed O-ring extend into engagement with the inner surface of the take-up spool. Thus, the clutch tension and slip thereof is not a function of the elastic limits or characteristics of a rubber belt, but are basically determined by the dimensions between the outside diameter of the inner hub, the basic size of the O-ring, and the inner diameter of the take-up spool. Basically, the drive for the take-up spool is a positive one because of the gear coupling to the inner input hub of the slip clutch. The only function of the deformed O-ring is that of a slipping clutch between the inner hub and the covering outer take-up spool.

Of course, by changing the size and diameter of the basic O-ring before deformation, the degree of friction and thus the amount of slipping of the clutch can be easily varied and modified as desired. Also, the material from which the ring is made, such as rubber, plastic, Teflon, and various other materials having different coefficients of friction, can be changed. Such change will vary the slip clutch function because of the differences of friction coefficient.

An object of the present invention is to provide a printer ribbon cartridge device having structure for maintaining the ribbon under tension whenever the cartridge is not in driving association with a printer.

A further object of the present invention is to provide a ribbon cartridge device having structure for preventing backwinding of the ribbon contained therein so as to prevent reuse of a used portion of the ribbon.

A still further object of the present invention is to provide a positive feed and drive structure for a printer ribbon in a cartridge structure, and yet providing a slipping clutch effect for the take-up spool to provide a change in drive tension as the diameter of the take-up spool increases.

Another further object of this invention is to provide a cartridge device for printer ribbon having complementary panel members for quick and easy assembly during the manufacture thereof with one panel member being provided with a plurality of spaced bosses having central apertures therein, to mate with and receive correspondingly spaced and aligned projections as formed with the other complementary panel member. Several bosses are also provided for use in positioning an anti-backwind pawl in order to permit the rapid assembly thereof. Also, other bosses are provided to perform a guiding function for the printer ribbon during the unwinding, feeding, and winding thereof.

These together with other objects and advantages which will become subsequently apparent reside in the details of construction and operation as more fully hereinafter described and claimed, reference being had to the accompanying drawing forming a part hereof, wherein like numerals refer to like parts throughout.

BRIEF DESCRIPTION OF THE DRAWING

FIG. 8 is an elevational view, partly in cross section, of the take-up spool slip clutch mechanism.

FIG. 9 is a top plan view, partly in cross section, taken generally along line 9—9 of FIG. 8.

FIG. 10 is a perspective view of the clutch mechanism in exploded form.

FIG. 11 is a bottom plan view of the clutch drive input gear tongue and groove connection.

DESCRIPTION OF THE PREFERRED EMBODIMENT

Figure 1:
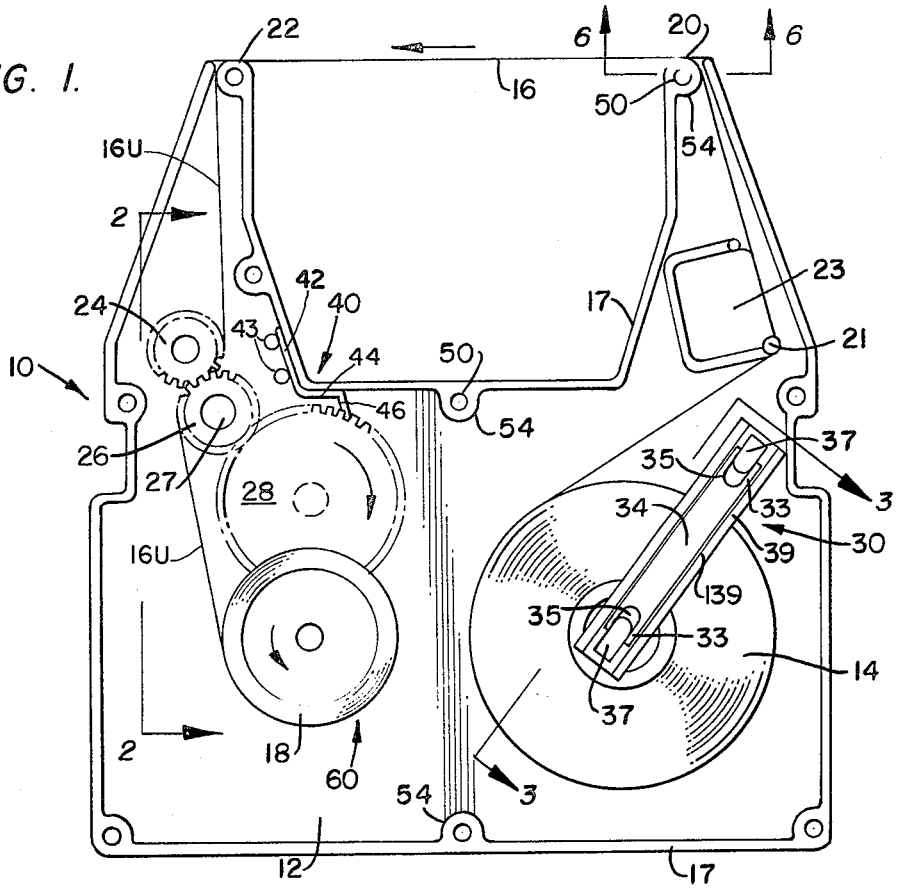
FIG. 1 is a top plan view of the printer ribbon cartridge device of this invention with the top panel member omitted.

A preferred embodiment of the invention will now be described by reference to the figures of drawing. Looking at FIG. 1, reference numeral 10 indicates in general the printer ribbon cartridge device of this invention. A primary main support panel member 12 has rotatably mounted thereon a printer ribbon supply 14, guide members 20, 21, 22 formed therewith for the printer ribbon 16, and a take-up spool 18.

In FIG. 1, the reference numeral 30 (also in FIG. 3) indicates the ribbon supply brake mechanism, reference numeral 40 indicates the anti-backwind mechanism, and reference numeral 60 indicates the slip clutch mechanism for the take-up spool 18.

Figure 2:
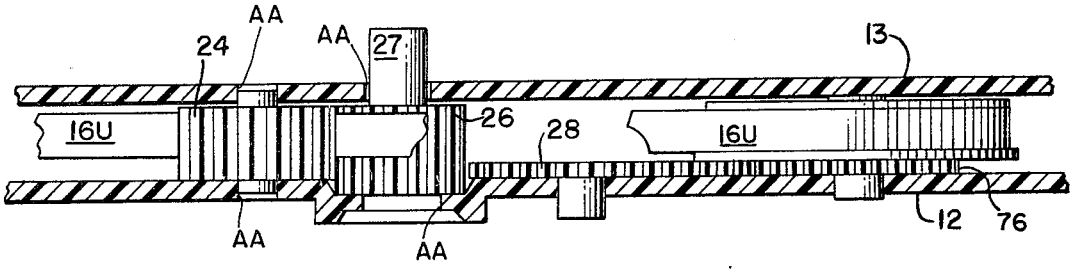
FIG. 2 is a side elevational view, partly in cross section, taken generally along line 2—2 of FIG. 1, and including the top panel member.
Figure 5:
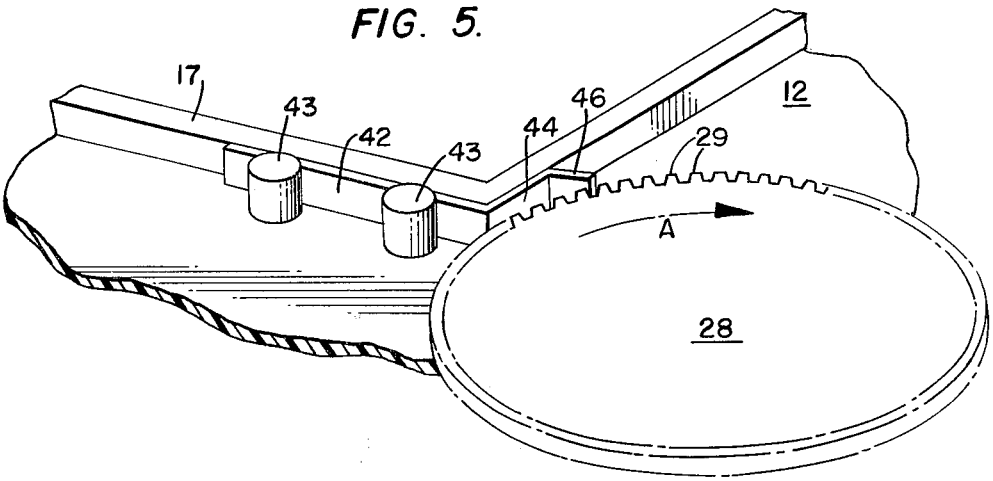
FIG. 5 is a perspective view of the one-way anti-backwind locking pawl and gear mechanism.

Guide members 20 and 22 provide an accurate, aligned path across which the printer ribbon 16 may be stretched under tension for operating association with a printer. Another guide member 21 is provided in alignment with the guide member 20, and an aperture 23 for reception of associated structure. Drive capstan feed gears 24 and 26 are rotatably mounted between panel members 12 and 13 for drive from an associated printer on the input shaft 27, as best seen in FIG. 2. A gear 28 is driven from the capstan gear 26, and associated with the angled end 46 of the anti-backwind pawl 44, as best seen in FIG. 5.

The one-way anti-backwind mechanism 40 functions in conjunction with the gear 28 because of the pawl member 42, 44 and 46. Projections or bosses 43 are formed as part of the main panel member 12 and have sufficient space between them and the reinforcing edge bead 17 for reception and holding of the main body portion 42 of the one-way pawl 44. The pawl member 42, 44, 46 preferably is made of metal, though other spring like materials such as plastic may be used. The angle formed between portions 44 and 46 is such that when the edge of portion 46 is in engagement with the teeth 29 of the gear 28, it will permit rotation of same in the direction A but will prevent the rotation thereof in the reverse direction. This is a very simple structure and yet performs a very important rewind preventing function in the overall cartridge device.

Figure 3:
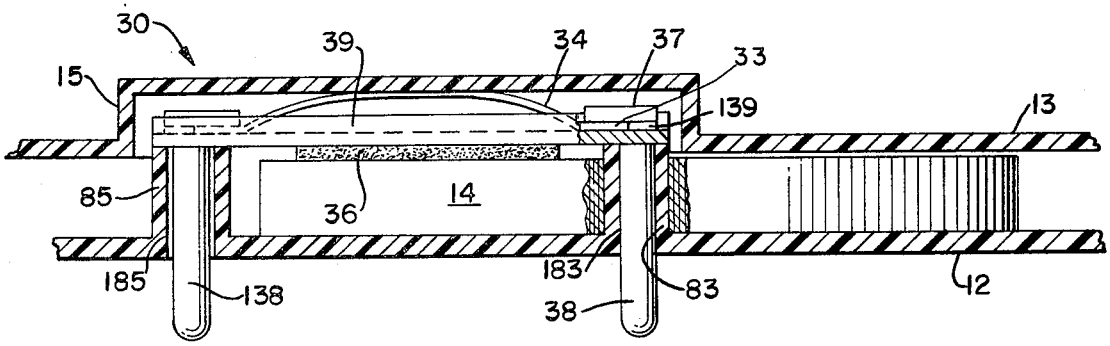
FIG. 3 is an elevational view, partly in cross section, taken generally along line 3—3 of FIG. 1, with the top panel member included and showing the ribbon supply brake structure in engagement.

The ribbon supply 14 and brake mechanism 30 will now be described in detail. FIG. 3 shows the brake mechanism 30 in cross section and also shows the association thereof with the other panel member 13 of the overall cartridge 10. This cartridge cover panel member 13 is provided with a recessed portion 15 for reception of the ribbon supply brake mechanism spring 34 and brake bar 39. The brake bar 39 is provided at each end thereof with pins 38 and 138 which extend through appropriate apertures 183, 185 provided in bosses 83, 85 formed on the main panel member 12. One of the bosses 83 also functions as the center spindle for the ribbon supply hub while the other boss 85 has an enlarged aperture 185 therethrough for loosely receiving and guiding pin 138.

The brake bar 39 is provided along the central length thereof with the substantial recess 139 for receiving the respective slotted ends of the spring 34. The slots 35 at each end of spring 34 provide extensions 33 (see FIG. 1) of the respective side ends of the spring 34 for guiding alignment with the brake bar recess 139 and the enlarged head guide members 37. FIG. 3 shows the recess 139 underneath the head guide member 37 for reception of the extensions 33 of the spring 34. Thus, spring 34 is constrained at each end thereof and yet permitted to freely flex and slide in the elongated recess 139 of the brake bar 39. A brake pad 36 is provided on the inner face of the brake bar 39.

Figure 4:
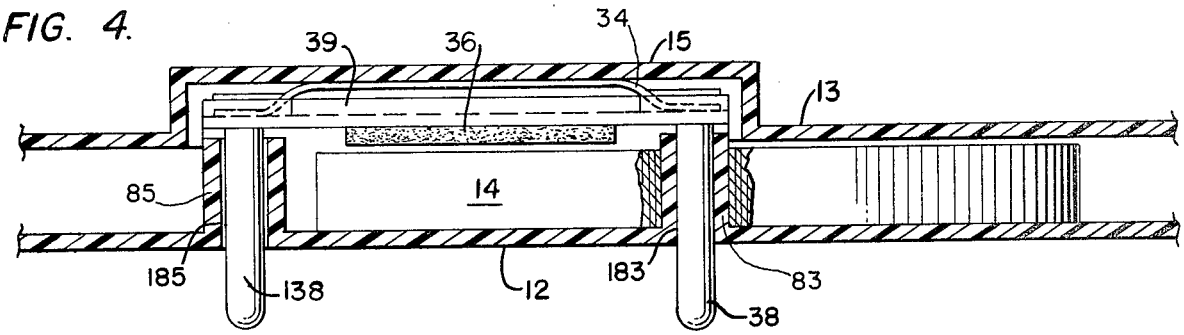
FIG. 4 is a view similar to that of FIG. 3 but with the brake structure disengaged from the ribbon supply.

Thus, as can be readily visualized by looking at FIG. 3, when the cartridge 10 is not in use and in place on a printer, the spring 34 forces the brake bar 39 and brake pad 36 against the ribbon supply 14. However, whenever the cartridge 10 is in position for proper use of the printing ribbon 16, then the pins 38, 138 are moved upwardly, as seen in FIG. 4, far enough to disengage the brake pad 36 from the ribbon supply 14.

This mechanism provides a very effective brake to prevent unwinding inadvertently of the ribbon 16 from the supply 14 whenever the cartridge 10 is not in place on a printer. It should be noted that the clearance between aperture 183 and pin 38 is fairly small while the clearance between pin 138 and the aperture 185 is much greater to provide a loose fit. This is important in the proper functioning of the brake mechanism 30 of this invention. The inventors have discovered that it is desirable to have the same center 83, 183 for both the ribbon supply 14 and the brake bar pin 38.

Figure 6:
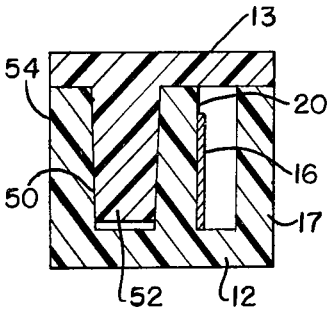
FIG. 6 is an elevational view, in cross section, taken generally along lines 6—6 of FIG. 1, with the top panel member in place.
Figure 7:
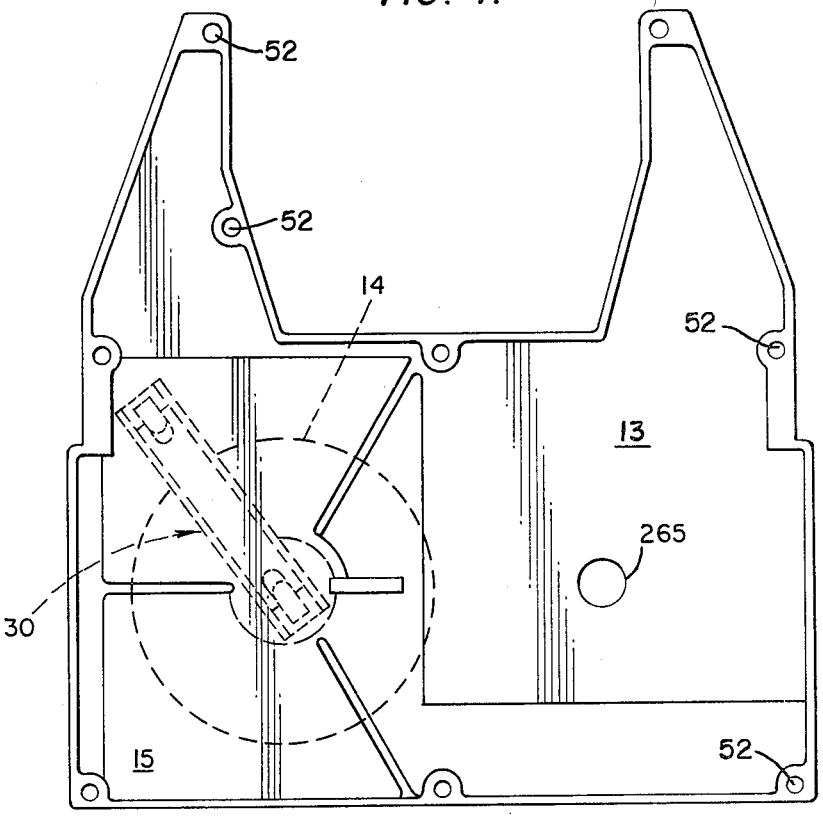
FIG. 7 is a bottom plan view of the top panel member showing the reinforcing bead structure and the assembly pin structure.

FIG. 6 shows one of the complementary pin and boss with aperture structures for holding the complementary cartridge cover panel members 12 and 13 together in their assembled relationship. Normally the main cartridge panel member 12 will be provided with a plurality of spaced and aligned boss structures 54 which are each provided with central apertures 50 therein. Similarly, spaced projecting pins 52 are corespondingly arranged and aligned on the secondary panel member 13 for mating friction engagement with the apertures 50 (FIG. 7). The respective panel members 12 and 13 (including bosses 54 and pins 52) may be formed of plastic material by conventional plastic forming and extruding techniques, and thus mass produced at relatively low cost. Some of the bosses 54 function on their outer surfaces as guides for the printer ribbon 16, such as the guide members 20 and 22 already described.

Looking at FIG. 2, the ribbon capstan feed gears 24 and 26 are rotatably supported in appropriate apertures AA provided in the panel members 12 and 13. The drive extension 27 for the main capstan gear 26 also is clearly shown. The ribbon 16 interweaves between the teeth of gears 24 and 26 for a positive, non-slip feed drive thereof as best seen in FIG. 1. Capstan drive gear 26 also in turn drives the anti-backwind gear 28 which in turn functions as a power transfer gear to drive the input gear 76 of the take-up spool slip clutch mechanism 60.

FIGS. 8 through 11 show the details of the take-up spool drive and slip clutch mechanism 60. A take-up spool hub 62 is provided having a central support axle 66 with ends which extend outwardly of the take-up spool hub 62 a sufficient distance to be supported rotatably in bearing apertures 165 and 265 appropriately provided in the panel members 12 and 13. The axle 66 also provides rotatable support for an inner hub member 72. This inner hub member 72 has an outer circumference and diameter slightly smaller than the inner circumference and diameter of the take-up spool hub 62. A recess 74 is provided across the entire diameter of the central portion of the inner hub member 72. Upstanding side portions 75 are present on each side of recess 74. The recesses 74 and side portions 75 function to retain an O-ring 70 in a deformed oval shape as best seen in FIG. 9. The outer circumferential portions of the deformed O-ring 70, taken across the longest part of the oval shape thereof, is of sufficient length to frictionally and resiliently engage with the inner wall surface 65 of the take-up hub 62. This two area contact is indicated by reference B in FIG. 9, and occurs at diametrically opposite portions of the O-ring 70 with the inner wall surface 65 of hub 62. Thus, the O-ring 70 having a certain resilient flexibility effects the desired slip clutch function, and also effectively transmits the input drive power from inner hub member 72 to the take-up hub spool 62. The outer circumference 63 of the take-up spool hub 62 together with the rim 64 cooperate with the initial ends of used ribbon 16U as being wound thereupon, or with a conventional spool.

FIGS. 10 and 11 clearly show the tongue and groove coupling between the positive drive input gear 76 and the clutch inner hub member 72. The bottom of the member 72 is provided with radial recesses 73 into which the tongues 78 of the gear 76 interfit. Thus, the gear 76 which is positively driven from gear 28, in turn positively drives the clutch inner hub member 72. Thus, the only clutch slipping action will take place between O-ring 70 and the inner wall surface 65 of the take-up hub 62.

Obviously both the ribbon supply 14 and the take-up spool hub 62 may support conventional ribbon spools thereon for ease in manipulation and interchanging of the ribbon 16 when it is desired to reuse the cartridge 10 and the subcomponents thereof.

The O-ring 70 is desirably made of resilient flexible material having a relatively high coefficient of friction. The O-ring 70 may be made of rubber or rubber like material, plastic material, Teflon material, or any other similar material. By merely changing one O-ring for another of different material having a different coefficient of friction, it is very easy to change the amount of slip clutch action for a particular batch of ribbon cartridge devices.

Another important feature of this invention is in the fact that capstan gear 24 in a sense may be considered an idler gear, since it is driven from the main capstan drive gear 26, with the used printer ribbon 16U passing therebetween. The new unused printer ribbon 16 normally has a coating on one side thereof of ink and iron oxide particles which must come off the ribbon 16 onto the data cards being imprinted therefrom. Of course the used ribbon 16U always has a certain residue of these particles remaining. The inventors have discovered that the use of normal hard plastic for all the gears 24, 26, 28, and 76 has certain disadvantages. By using hard plastic for both gears 24 and 26, the particle residue on the used printing ribbon 16U tends to clog up in the teeth of these gears 24, 26 to cause problems.

In the printer ribbon cartridge 10 of this invention, the idler gear 24 is preferably made of a rubber-like material of soft plastic composition such as presently sold under the trade name of KRATON. The other capstan feed gear 26 is preferably formed of hard plastic material from the family of plastics known as ACETAL. One of these plastics is currently available under the trade name of DELRIN.

The inventors have discovered that by making idler gear 24 of soft plastic (rubber-like material) and capstan gear 26 of hard plastic there is a very desirable benefit including a self-cleaning action between the gear teeth and the used printing ribbon 16U passing therebetween. This action is effected by the flexing of the resilient idler gear 24 made of soft plastic in order to throw off the residue particles which normally would tend to accumulate on these gears 24, 26. Preferably the gears 28 and 76 are also made of hard plastic similar to gear 26.

All of the components can be fabricated on mass production lines, and then assembled in a relatively quick and easy manner, and at a relatively low cost.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed is:

1. A cartridge for printing ribbon comprising:
- a main panel member;
- a secondary panel member;
- means for interlocking said panel members together to form a container cartridge;
- a printing ribbon supply rotatably mounted between said panel members;
- brake means associated with said printing ribbon supply which is biased for engagement therewith whenever the cartridge is not in working position with a printing device in order to prevent inadvertent unwinding of the printing ribbon;
- guiding means for said printing ribbon;
- capstan feed means for said printing ribbon;
- a take-up spool for used printing ribbon;
- positive drive means between said capstan feed means and said take-up spool; and, means for effecting a slip clutch function between said positive drive means and said take-up spool including a central hub member which is driven from said positive drive means, a deformed ring member supported by said central hub member, and an outer spool hub rotatably supported between said panel members and driven by friction engagement internally thereof by said deformed ring member.

2. The structure as set forth in claim 3, together with anti-backwind means to prevent reverse feed of the printing ribbon by said capstan feed means in order to avoid accidental rewinding of used ribbon upon the printing ribbon supply in order to prevent reuse thereof.

3. The structure as set forth in claim 2, wherein the capstan feed means includes two gears having mating teeth for driving reception of the printing ribbon therebetween to provide a positive feed drive for said ribbon.

4. The structure as set forth in claim 3, wherein the anti-backwind means includes a pawl member mounted on at least one of said panel members, and provided with an angled teeth engaging edge for association with the teeth of a driven gear to permit rotation of said driven gear in one direction only, said driven gear being in driving engagement with one of the two gears of said capstan feed means for positive non-slip drive thereof at all times.

5. The structure as set forth in claim 2, wherein the anti-backwind means includes a pawl member mounted on at least one of said panel members, and provided with an angled teeth engaging edge for association with a driven gear to permit rotation of said gear in one direction only, said gear being in driving engagement with said capstan feed means for positive non-slip operation at all times.

6. The structure as set forth in claim 1, wherein the guiding means for said printing ribbon includes a plurality of formed bosses on at least one of said panel members so spaced and aligned as to form a desired path for the printing ribbon along a predetermined area.

7. The structure as set forth in claim 1, wherein the means for interlocking said panel members together includes a plurality of bosses having central apertures provided on one of said panel members, and the other panel member having projecting pins for complementary mating with said boss apertures to secure the panel members together in assembled relationship.

8. The structure as set forth in claim 3, wherein the positive drive means includes a gear in engagement with the central hub member which is removably connected thereto by a plurality of tongue and groove portions formed on the gear and the central hub member.

9. The structure of claim 1, wherein said brake means includes a movable brake bar, a high coefficient of friction brake pad supported thereon for engagement with the printing ribbon supply, resilient means engaged with said brake bar for biasing the brake bar into braking engagement with the printing ribbon supply, and at least one aligning and guiding pin for constraining said brake bar in a desired path of movement.

10. A cartridge for printing ribbon comprising:

a main panel member;

a secondary panel member;

means for interlocking said panel members together to form a container cartridge;

a printing ribbon supply rotatably mounted between said panel members;

brake means associated with said printing ribbon supply which is biased for engagement therewith whenever the cartridge is not in working position with a printing device in order to prevent inadvertent unwinding of the printing ribbon;

guiding means for said printing ribbon;

capstan feed means for said printing ribbon;

a take-up spool for used printing ribbon;

positive drive means between said capstan feed means and said take-up spool;

means for effecting a slip clutch function between said positive drive means and said take-up spool;

said brake means including a movable brake bar, a high coefficient of friction brake pad supported thereon for engagement with the printing ribbon supply, resilient means engaged with said brake bar for biasing the brake bar into braking engagement with the ribbon supply, at least one aligning and guiding pin for constraining said brake bar in a desired path of movement; and wherein the brake bar is provided with a longitudinally extending recess therein, the resilient means consists of a flat spring having at least one end slidable in said recess, and guiding means between said at least one spring end and said brake bar for assuring proper orientation and guided movement of the spring end within the recess.

11. A structure as set forth in claim 10, wherein the guiding means for said printing ribbon incudes a plurality of formed guide bosses in at least one of said panel members spaced and aligned so as to form a desired path for the printing ribbon along a predetermined area.

12. The structure as set forth in claim 10, wherein the capstan feed means includes two gears having mating teeth for driving reception of the printing ribbon therebetween to provide a positive feed drive for said ribbon.

13. The structure as set forth in claim 10, wherein the means for interlocking said panel members together includes a plurality of bosses having central apertures provided on one of said panel members, and the other panel member having projecting pins for complementary mating with said boss apertures to secure the panel members together in assembled relationship.

14. A cartridge for printing ribbon comprising:

a main panel member;

a secondary panel member;

means for interlocking said panel members together to form a container cartridge;

a printing ribbon supply rotatably mounted between said panel members;

brake means associated with said printing ribbon supply which is biased for engagement therewith whenever the cartridge is not in working position with a printing device in order to prevent inadvertent unwinding of the printing ribbon;

guiding means for said printing ribbon;

capstan feed means for said printing ribbon;

a take-up spool for used printing ribbon;

positive drive means between said capstan feed means and said take-up spool;

means for effecting a slip clutch function between said positive drive means and said take-up spool;

said brake means including a movable brake bar, a high coefficient of friction brake pad supported thereon for engagement with the printing ribbon supply, resilient means engaged with said brake bar for biasing the brake bar into braking engagement with the ribbon supply, at least one aligning and guiding pin for constraining said brake bar in a desired path of movement; and wherein two of said guiding and aligning pins are provided on said brake bar, the first guiding and aligning pin being mounted with a close sliding fit engagement within a guiding aperture in one of said cartridge panel members, while the other pin has a relatively loose sliding fit engagement with another guiding aperture in said one panel member.

15. The structure as set forth in claim 14, wherein said capstan feed means includes two gears having mating teeth for a driving reception of the printing ribbon therebetween in order to provide a positive feed drive for said ribbon, at least one of said gears being formed of rubber-like material to provide a self-cleaning function for the capstan feed means.

16. A structure as set forth in claim 15, wherein the rubber-like material from which said at least one gear is made consists of soft plastic, and the other gear of said capstan feed means is made of hard plastic material.

17. A cartridge for printing ribbon comprising:

a main panel member;

a secondary panel member;

means for interlocking said panel members together to form a container cartridge;

a printing ribbon supply rotatably mounted between said panel members;

brake means associated with said printing ribbon supply which is biased for engagement therewith whenever the cartridge is not in working position with a printing device in order to prevent inadvertent unwinding of the printing ribbon;

guiding means for said printing ribbon;

capstan feed means for said printing ribbon;

a take-up spool for used printing ribbon;

positive drive means between said capstan feed means and said take-up spool;

means for effecting a slip clutch function between said positive drive means and said take-up spool;

said brake means including a movable brake bar, a high coefficient of friction brake pad supported thereon for engagement with the printing ribbon supply, resilient means engaged with said brake bar for biasing the brake bar into braking engagement with the ribbon supply, at least one aligning and guiding pin for constraining said brake bar in a desired path of movement; and wherein the means for effecting a slip clutch function for the take-up spool includes a central hub member which is driven from said positive drive means, a deformed ring member supported by said central hub member, and an outer spool hub rotatably supported between said two panel members and driven by friction engagement internally thereof by said deformed ring member.

18. The structure as set forth in claim 17, wherein the deformed ring member is normally of full ring shape, a diametrical recess is provided in the central hub member, and the ring member is deformed and held in said recess so that two outer circumferential edges of the ring member extend beyond the central hub member for friction engagement with the inside surface of the outer spool hub.

* * * * *

UNITED STATES PATENT AND TRADEMARK OFFICE

CERTIFICATE OF CORRECTION

PATENT NO. : 4,272,202

DATED : June 9, 1981

INVENTOR(S) : Schroeder et al

It is certified that error appears in the above—identified patent and that said Letters Patent is hereby corrected as shown below:

Front page [54] - in the title "BROKEN" s/b --BRAKE--;

Col. 2, line 38, "Teflon" s/b --TEFLON--.

Col. 4, line 32, "of" s/b --on--.

Col. 5, line 40, after "take-up" insert --spool--;
line 46, delete "hub";
line 47, after "spool" insert --hub--;
line 60, before "hub" insert --spool--.

Col. 6, line 1, "Teflon" s/b/ --TEFLON--;
line 2, after "O-ring" insert --70--.

Col. 7, line 10, claim 2 should depend from --claim 1--;
line 15, claim 3 should depend from --claim 1--;
line 19, claim 4 should depend from --claim 1--;
line 48, claim 8 should depend from --claim 1--.

Signed and Sealed this

*Third* Day of *August 1982*

[SEAL]

*Attest:*

GERALD J. MOSSINGHOFF

*Attesting Officer*

*Commissioner of Patents and Trademarks*